US007048460B1

(12) United States Patent
Thompson et al.

(10) Patent No.: US 7,048,460 B1
(45) Date of Patent: May 23, 2006

(54) PORTABLE COMBINATION TOOTHBRUSH AND TOOTHPASTE DISPENSER

(76) Inventors: Nicole Thompson, 3178 William Rd., Boothwyn, PA (US) 19061; Ron Thompson, 3178 William Rd., Boothwyn, PA (US) 19061

( * ) Notice: Subject to any disclaimer, the term of this patent is extended or adjusted under 35 U.S.C. 154(b) by 0 days.

(21) Appl. No.: 11/056,916

(22) Filed: Feb. 11, 2005

(51) Int. Cl.
*A46B 11/04* (2006.01)
*A46B 11/00* (2006.01)
*A46B 17/04* (2006.01)

(52) U.S. Cl. ..... 401/277; 401/123; 401/124; 401/125; 401/269

(58) Field of Classification Search ..... 401/123, 401/124, 125, 277, 175, 131, 98, 269
See application file for complete search history.

(56) References Cited

U.S. PATENT DOCUMENTS 1,420,581 A * 6/1922 Schoneman ..... 401/124
1,423,405 A * 7/1922 Dayeh ..... 401/124
1,653,987 A * 12/1927 Cliffe ..... 401/129
3,734,118 A * 5/1973 Howard ..... 132/311
3,842,850 A * 10/1974 Sanders ..... 132/311
4,332,497 A 6/1982 Rodriguez ..... 401/154
4,622,984 A 11/1986 Gaebel ..... 132/84
5,908,257 A 6/1999 Martin ..... 401/271
5,987,691 A * 11/1999 Jurt et al. ..... 15/167.1

* cited by examiner

*Primary Examiner*—David J. Walczak
(74) *Attorney, Agent, or Firm*—Goldstein Law Offices P.C.

(57) ABSTRACT

A portable combination toothbrush and toothpaste dispenser device within a casing for providing a convenient and hygienic means of brushing teeth. The casing includes a toothbrush, a toothpaste dispenser, and includes a top end and a bottom end. The bottom end has a ribbed circular dispensing wheel connected to an internal plunger assembly. The plunger assembly has a circular platform which pushes toothpaste upwardly and a funnel cap which dispenses the toothpaste outwardly onto the toothbrush. The toothbrush has bristles and a handle that extends upwardly and downwardly from within the casing. A cap fits onto the bottom end of the casing in an open position ready for use and onto the top end of the casing in a closed position for storage.

3 Claims, 3 Drawing Sheets

PORTABLE COMBINATION TOOTHBRUSH AND TOOTHPASTE DISPENSER

BACKGROUND OF THE INVENTION

The invention relates to toothbrush devices, and more particularly, to a portable combination toothbrush and toothpaste dispenser for providing consumers with a convenient and hygienic means of brushing teeth whenever needed.

Brushing one's teeth is one of the most important parts of healthy hygiene. In addition to freshening the breath and strengthening the teeth, proper brushing also kills the germs and bacteria that can grow inside the mouth. To have a healthy smile, the American Dental Association recommends that teeth should be brushed at least twice daily, preferably after meals. However, this recommendation can often prove easier to be said than done. The hectic days of work, school, or traveling make it impractical to cart around a toothbrush and bulky tube of toothpaste. However, the longer food particles remain in the mouth, the teeth can become susceptible to the formation of cavities and decay.

U.S. Pat. No. 4,332,497 to Rodriguez discloses a combination toothbrush having a hollow handle with a rotatable knob for dispensing toothpaste out through the bristles. U.S. Pat. No. 4,622,984 to Gaebel and U.S. Pat. No. 5,908,257 to Martin disclose various combination toothbrush devices with means to store and dispense toothpaste through the bristles.

While these units may be suitable for the particular purpose employed, or for general use, they would not be as suitable for the purposes of the present invention as disclosed hereafter.

SUMMARY OF THE INVENTION

It is an object of the invention to produce a convenient and hygienic means of brushing teeth whenever needed. Accordingly, the invention is a portable combination toothbrush and toothpaste dispenser for providing a convenient and hygienic means of brushing teeth whenever needed.

It is another object of the invention to provide a toothbrush that is more effective and comfortable for brushing teeth. Accordingly, the dispenser of the invention includes a toothbrush having a head having short, fiber bristles having rounded edges to facilitate a cleaning that is both effective and comfortable.

It is another object of the invention to provide a simple means for dispensing toothpaste directly onto the toothbrush. Accordingly, the invention includes a casing having a ribbed circular dispensing wheel connected to an internal plunger assembly for simply pushing toothpaste upwardly through a funnel cap and directly onto bristles of the toothbrush.

This invention is a portable combination toothbrush and toothpaste dispenser device within a casing for providing a convenient and hygienic means of brushing teeth. The casing includes a toothbrush, a toothpaste dispenser, and includes a top end and a bottom end. The bottom end has a ribbed circular dispensing wheel connected to an internal plunger assembly. The plunger assembly has a circular platform which pushes toothpaste upwardly and a funnel cap which dispenses the toothpaste outwardly onto the toothbrush. The toothbrush has bristles and a handle that extends upwardly and downwardly from within the casing. A cap fits onto the bottom end of the casing in an open position ready for use and onto the top end of the casing in a closed position for storage.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
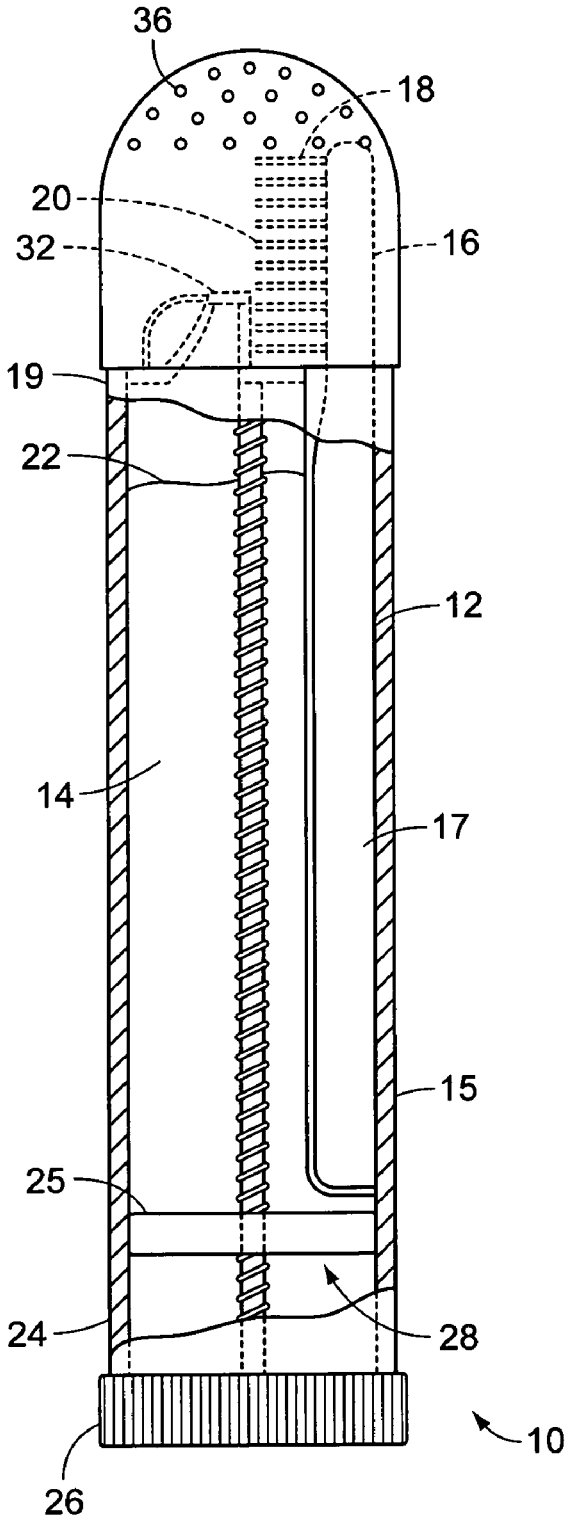
FIG. 1 is a cross-sectional view of the portable combination toothbrush and toothpaste dispenser of the present invention having a cap, funnel cap, toothbrush, toothpaste dispenser, and dispensing wheel.

FIG. 1 illustrates a portable combination toothbrush and toothpaste dispenser device 10 for providing a convenient and hygienic means of brushing teeth whenever needed. The device 10 includes a toothbrush 12 and a toothpaste receptacle 14, incorporated into one complete casing 15. Preferably, the device 10 measures between seven inches and eight inches in length, and is substantially tubular in shape. The toothbrush 12 includes a handle 17; a head 16 having short, fiber bristles 18 having rounded edges 20 to facilitate a cleaning that is both effective and comfortable.

Situated within the casing 15 directly around the toothbrush 12, is the internally configured toothpaste receptacle 14 having toothpaste 22 therein, for easy and directly dispensing toothpaste onto the bristles 18 of the toothbrush 12.

The casing 15 includes a top end 19 and a bottom end 24 near the handle 17 where the device 10 is held. The bottom end 24 has a ribbed circular dispensing wheel 26 for dispensing toothpaste 22 therefrom. The wheel 26 is connected to an internal plunger assembly 28 including a circular platform 25 which pushes the toothpaste 22 upwardly. The internal plunger assembly 28 also includes a funnel cap 32 positioned adjacent and directly in front of the bristles 18. When the wheel 26 is twisted toothpaste 22 dispenses from with the toothpaste receptacle 14 through the funnel cap 32 directly onto the bristles 18.

A cap 34 fits onto the top end 19 of the casing 15 and includes a plurality of holes 36 extending therethrough for allowing air to dry the bristles 18. When in use, the cap 34 fits onto the wheel 26 on the bottom end 24 of the casing 15.

Figure 2:
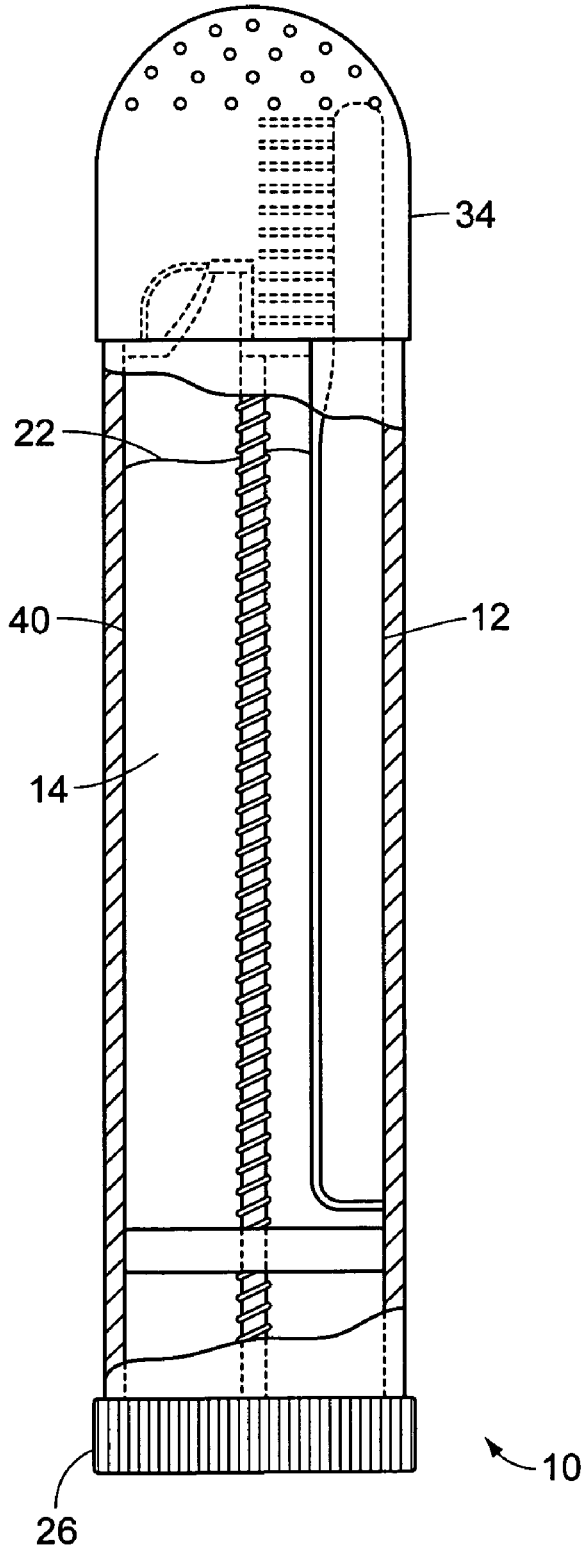
FIG. 2 is a cross-sectional view of the portable combination toothbrush and toothpaste dispenser of the present invention in a compact position.

FIG. 2 illustrates the portable combination toothbrush and toothpaste dispenser device 10 of the present invention in a compact position 40. Here, the cap 34 is positioned covering the toothbrush 12 and toothpaste receptacle 14 and can be easily carried around in a purse or pocket.

Figure 3:
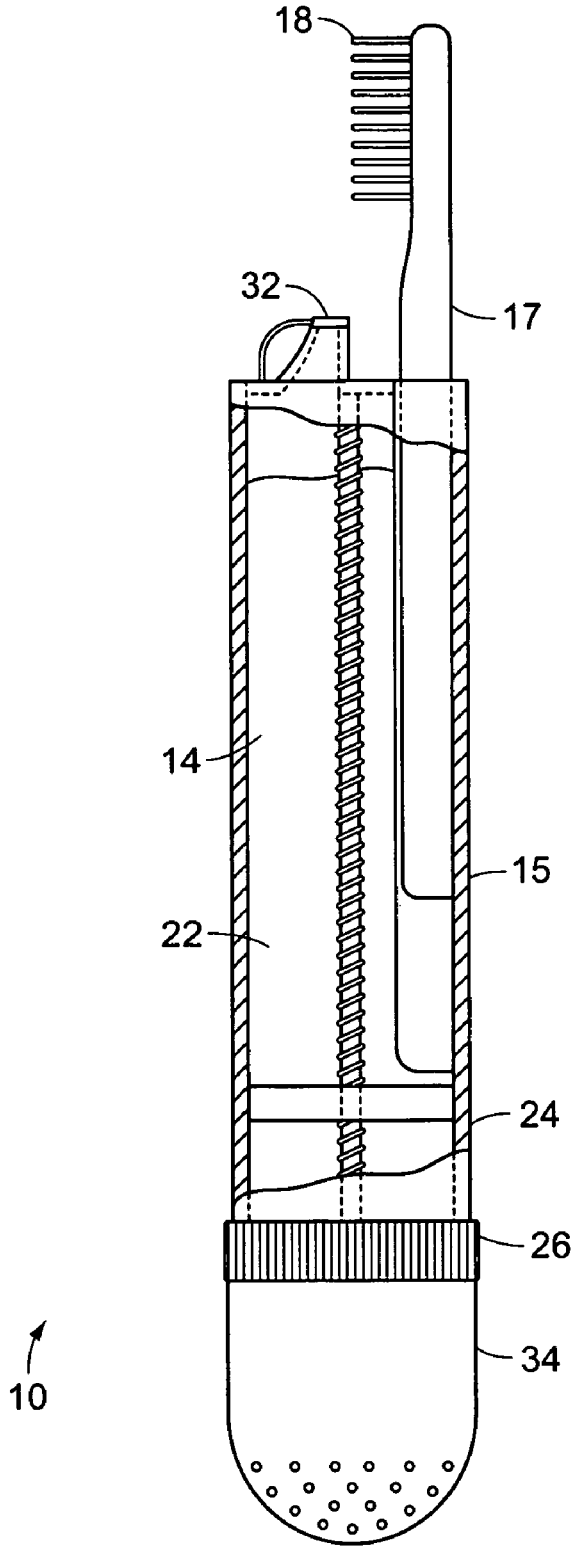
FIG. 3 is a cross-sectional view of the portable combination toothbrush and toothpaste dispenser of the present invention in an open position ready for use.

FIG. 3 illustrates the portable combination toothbrush and toothpaste dispenser device 10 of the present invention in an open position ready for use. A user simple removes the cap 34 from the top end 19 and fits the cap 34 onto the wheel 26 on the bottom end 24 of the casing 15, as shown in FIG. 3. Then the user twists the wheel 26 on the bottom end 24 and causes the toothpaste 22 to be dispensed through the toothpaste receptacle 14 from the funnel cap 32 directly onto the bristles 18. After the desired amount of toothpaste 22 is dispensed, the user extends the handle 17 of the toothbrush 12 upwardly from within the casing 15, allowing the head 16 to extend outwardly, and brushes teeth as normal. When finished brushing, the bristles 18 can be cleaned with water and the handle 17 of the toothbrush 12 then slides backwardly into the casing 15 and the cap 34 is recapped and stored away until needed again.

In conclusion, herein is presented a portable combination toothbrush and toothpaste dispenser. The invention is illustrated by example in the drawing figures, and throughout the written description. It should be understood that numerous variations are possible, while adhering to the inventive concept. Such variations are contemplated as being a part of the present invention.

What is claimed is:

1. A portable combination toothbrush and toothpaste dispenser device for providing a convenient and hygienic means of brushing teeth, comprising:

a casing having a top end and a bottom end, the bottom end having a ribbed circular dispensing wheel being connected to an internal plunger assembly including a circular platform which pushes toothpaste upwardly and a funnel cap;

a toothbrush having a handle that extends upwardly and downwardly from within the casing having a head having short, fiber bristles having rounded edges and being positionable adjacent to the funnel cap;

an internally configured toothpaste receptacle situated within the casing directly around the toothbrush having toothpaste therein, for directly dispensing onto the bristles of the toothbrush; and a cap fitting onto the wheel in an open position ready for use and onto the top end of the casing in a closed position and including a plurality of holes extending therethrough for allowing air to dry the bristles.

2. A portable combination toothbrush and toothpaste dispenser device for providing a convenient and hygienic means of brushing teeth, comprising:

a casing having a top end and a bottom end, the bottom end having a ribbed circular dispensing wheel being connected to an internal plunger assembly including a circular platform which pushes toothpaste upwardly and a funnel cap;

a toothbrush having a handle that extends upwardly and downwardly from within the casing having a head having bristles and being positionable adjacent to the funnel cap, the bristles are short, fiber bristles having rounded edges;

an internally configured toothpaste receptacle situated within the casing directly around the toothbrush having toothpaste therein, for directly dispensing onto the bristles of the toothbrush; and a cap that selectively fits onto the wheel in an open position and top end of the casing in a closed position, the cap has a plurality of holes extending therethrough for allowing air to dry the bristles when in the closed position.

3. A method of easily and efficiently brushing teeth using a portable toothbrush and toothpaste dispensing device having a casing having a top end and a bottom end, the bottom end having a ribbed circular dispensing wheel being connected to an internal plunger assembly including a circular platform which pushes toothpaste upwardly and a funnel cap, having a toothbrush having a handle that extends upwardly and downwardly from within the casing having a head having bristles and being positionable adjacent to the funnel cap, having an internally configured toothpaste receptacle situated within the casing directly around the toothbrush having toothpaste therein, and having a cap, the steps comprising:

removing the cap from the top end of the casing and fitting the cap onto the wheel on the bottom end of the casing;

dispensing toothpaste onto the bristles of the toothbrush by twisting the wheel on the bottom end causing the toothpaste to be dispensed through the toothpaste receptacle from the funnel cap directly onto the bristles;

brushing teeth as normal by extending the handle of the toothbrush upwardly and the head of the toothbrush outwardly from within the casing;

cleaning the bristles with water after use; and sliding the handle backwardly into the casing and recapping the cap onto the top end of the casing for storage.

* * * * *